US005677985A

United States Patent [19]

Ozawa

[11] Patent Number: 5,677,985

[45] Date of Patent: Oct. 14, 1997

[54] SPEECH DECODER CAPABLE OF REPRODUCING WELL BACKGROUND NOISE

[75] Inventor: Kazunori Ozawa, Tokyo, Japan

[73] Assignee: NEC Corporation, Tokyo, Japan

[21] Appl. No.: 350,889

[22] Filed: Dec. 7, 1994

[30] Foreign Application Priority Data

Dec. 10, 1993 [JP] Japan ..... 5-310521

[51] Int. Cl.[6] ..... G10L 3/02

[52] U.S. Cl. ..... 395/2.29; 395/2.32; 395/2.34

[58] Field of Search ..... 395/2.29, 2.32, 395/2.35, 2.42, 2.39, 2.34

[56] References Cited

U.S. PATENT DOCUMENTS

| | | | |
|---|---|---|---|
| 5,208,862 | 5/1993 | Ozawa | 381/36 |
| 5,265,167 | 11/1993 | Akamine et al. | 381/40 |
| 5,307,441 | 4/1994 | Tzeng | 395/2.31 |

FOREIGN PATENT DOCUMENTS 3-243999 10/1991 Japan .

OTHER PUBLICATIONS

Schroeder, Manfred R., "Code-Excited Linear Prediction (CELP): High-Quality Speech at Very Low Bit Rates", *Proc. ICASSP*, 1985, pp. 937–940.

Lynch, Jr., J. F. et al., "Speech/Silence Segmentation for Real-Time Coding Via Rule Based Adaptive Endpoint Detection", *Proc. ICASSP*, 1987, pp. 1348–1351.

Sugamura et al., "Quantizer Design in LSP Speech Analysis–Synthesis", *IEEE Journal on Selected Areas in Communications*, vol. 6, No. 2, Feb. 1988, pp. 433–440.

*Primary Examiner*—Allen R. MacDonald
*Assistant Examiner*—Richemond Dorvil
*Attorney, Agent, or Firm*—Foley & Lardner

[57] ABSTRACT

When background noise is superposed on speech, a speech decoder can well represent the background noise through signal processing only in the speech decoder even at low bit rates. In the speech decoder, a decoding circuit receives a signal from a speech coder, a speech detecting circuit detects non-speech and speech intervals, and a excitation signal calculating circuit calculates a excitation signal using a sound source signal, a pitch period, and an average amplitude. A signal reproducing circuit drives a filter composed of a spectrum parameter to reproduce a sound signal. A searching circuit stores a set of random number code vectors of a predetermined bit number as a code book, and searches the code book for a best random number code vector which is selected. A second signal reproducing circuit reproduces a sound signal (noise) using the selected random number code vector.

10 Claims, 6 Drawing Sheets

100
INPUT SIGNAL
110
DE-CODING CIRCUIT
c(n)
r
T
I (i)
120
SPEECH DETECTING CIRCUIT
140
EXCITATION SIGNAL GENERATING CIRCUIT
250
SEARCHING CIRCUIT
200
CODE BOOK
240
260
SIGNAL RE-PRODUCING CIRCUIT
230
SOUND SIGNAL

100
INPUT SIGNAL
110
DE-CODING CIRCUIT
c(n)
r
T
I (i)
120
SPEECH DETECTING CIRCUIT
140
EXCITATION SIGNAL GENERATING CIRCUIT
250
SEARCHING CIRCUIT
240
260
SIGNAL RE-PRODUCING CIRCUIT
230
SOUND SIGNAL
200
CODE BOOK
320
UPDATING CIRCUIT

SPEECH DECODER CAPABLE OF REPRODUCING WELL BACKGROUND NOISE

BACKGROUND OF THE INVENTION

1. Field of the Invention

The present invention relates to a system for reproducing well background noise superposed on a speech signal, and more particularly to a speech decoder for improving the reproducibility of background noise to increase speech quality through signal processing only at a receiver side without getting any auxiliary information from a transmitter side relative to background noise.

2. Description of the Prior Art

One known system for coding and decoding speech signals transmitted at low bit rates is a CELP system as described in "CODE-EXCITED LINEAR PREDICTION (CELP): HIGH-QUALITY SPEECH AT VERY LOW BIT RATES" written by M. R. Schroeder and B. S. Atal (Proc. ICASSP, pp. 937–940, 1985) (literature 1). A system for improving speech quality at the CELP low bit rates is disclosed in Japanese Patent Application Laid-open No. 3-243999 (literature 2).

The conventional systems disclosed in the literatures 1, 2 have a problem in that when background noise is superposed on a speech signal, it is difficult to represent well the background noise in non-speech intervals, resulting in poor speech quality, at low bit rates of 4.8 kb/s or lower.

SUMMARY OF THE INVENTION

It is an object of the present invention to provide a speech decoder for reproducing well a background noise signal through a speech decoding process at a receiver without any changes in coded speed signals and without any added auxiliary information from a coder.

It is another object of the present invention to provide a speech decoder for reproducing noise in a non-speech interval from a random number code vector, and use the reproduced noise as the background noise which makes a transmitted sound natural to the ear and does not disturb hearing in the non-speech interval.

According to a first aspect of the present invention, there is provided a speech decoder comprising decoding means for decoding a binary coded input signal into a spectral parameter, an average amplitude, a pitch period and a sound source signal; speech detecting means for detecting a non-speech interval and a speech interval using at least one among the spectral parameter, the average amplitude and the pitch period; excitation signal generating means for generating an excitation signal using the sound source signal, the average amplitude, and the pitch period; first signal reproducing means for reproducing a sound signal using the excitation signal from the excitation signal generating means and the spectral parameter from said decoding means; memorizing means for memorizing a random number code book storing random number code vectors which can be used in reproducing sound signals; searching means for searching the random number code book and selecting a random number code vector which can be used to reproduce a sound signal that is closest to the output signal reproduced in the non-speech interval by said first signal reproducing means; second signal reproducing means for reproducing a sound signal using the spectral parameter from said decoding means and the random number code vector which has been searched by said searching means; and switching means for outputting the sound signal from said first signal reproducing means in the speech interval and outputting the sound signal from said second signal reproducing means in the non-speech interval.

According to a second aspect of the present invention, there is provided a speech decoder comprising decoding means for decoding a binary coded input signal into a spectral parameter, an average amplitude, a pitch period and a sound source signal; speech detecting means for detecting a non-speech interval and a speech interval using at least one among the spectral parameter, the average amplitude and the pitch period; excitation signal generating means for generating an excitation signal using the sound source signal, the average amplitude, and the pitch period; memorizing means for memorizing a random number code book storing random number code vectors which can be used in reproducing sound signals; searching means for searching the random number code book for a random number code vector which can be used in reproducing a sound signal that is closest to a sound signal reproducible from the excitation signal in the non-speech interval; switching means for outputting the excitation signal from said excitation signal generating means in the speech interval and outputting the random number code vector which has been searched in the non-speech interval by said searching means; and signal reproducing means for reproducing a sound signal using the spectral parameter from said decoding means and the output from the switching means.

It is preferable that the searching means of the speech decoder calculates a gain which is used by the second signal reproducing means for adjusting an average amplitude of the sound signal which is reproduced from the selected random number code vector such that the average amplitudes of the sound signals of the first and second signal reproducing means become nearly equal in the non-speech interval.

Further preferably, the excitation signal generating means comprises suppressing means for suppressing the average amplitude in the non-speech interval.

The searching means comprises updating means for updating the random number code book at a predetermined interval of time.

According to the present invention, the decoding means receives a binary coded input signal and converts it into a spectral parameter, an average amplitude, a pitch period and a sound source signal,and the speech detecting means compares at least one among the spectrum parameter, the average amplitude, and the pitch period, e.g., the average amplitude, with a predetermined threshold to detect the speech and non-speech intervals.

Alternatively, a process described in "SPEECH/SILENCE SEGMENTATION FOR REAL-TIME CODING VIA RULE BASED ADAPTIVE ENDPOINT DETECTION" written by J. Lynch, Jr., et al. (Proc. ICASSP, pp. 1348–1351, 1987) (literature 3) may be employed.

The excitation signal generating means generates an excitation signal using the sound source signal, the average amplitude, and the pitch period which are received by the decoding means, and the first signal reproducing means drives a filter composed of the spectrum parameter to reproduce a sound signal s(n).

The searching means stores a set of random number code vectors of a predetermined bit number as a code book, and searches the code book for a random number code vector which maximizes the following equation:

$$D_j = \sum_{n=0}^{N-1} \psi(n) c_j(n) \quad (1)$$

(j=0 $2^B-1$, is the number of bits of the code book) where $$\psi(i) = \sum_{n=0}^{N-1} s(n-i) h(n) \quad (2)$$

where s(n) is a reproduced signal produced by the first signal reproducing means (j(n) is the j-th random number code vector), and h(n) is an impulse response determined from the spectrum parameter used for the filter.

The speech decoder according to the second aspect of the present invention operates in a manner different from the speech decoder according to the first aspect of the present invention, by employing the equation, given below, rather than the equations (1) and (2) above.

$$D'_j = \sum_{n=0}^{N-1} v(n) c_j(n) \quad (3)$$

(j=0 . . . $2^B-1$, is the number of bits of the code book) where v(n) is the excitation signal referred to above in the speech decoder according to the first aspect of the present invention.

The above and other objects, features, and advantages of the present invention will become apparent from the following description referring to the accompanying drawings which illustrate an example of preferred embodiments of the present invention.

DETAILED DESCRIPTION OF THE PREFERRED EMBODIMENTS

Figure 1:
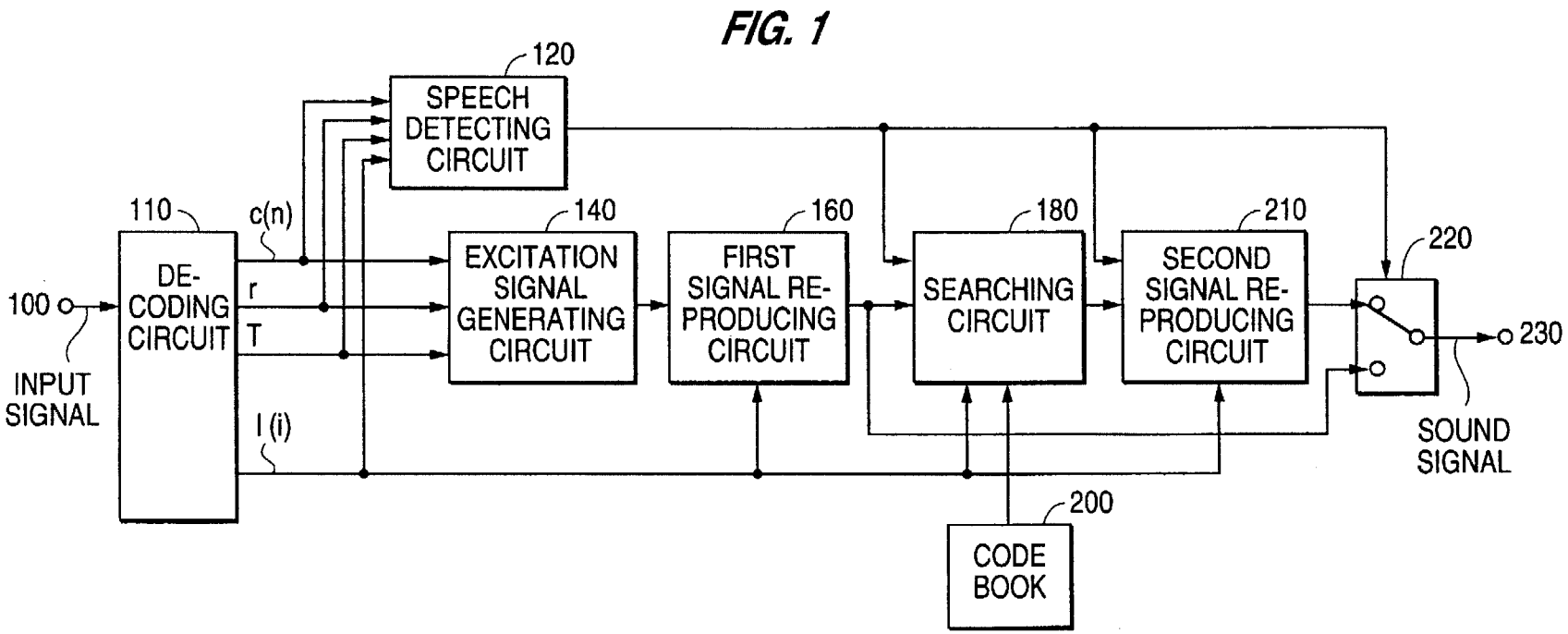
FIG. 1 is a block diagram of a speech decoder according to a first embodiment of the present invention.

As shown in FIG. 1, a speech decoder according to a first embodiment of the present invention has an input terminal 110 which is supplied with a binary coded input signal and an output terminal 230 from which a reproduced sound signal (a speech signal in a speech interval and noise in a non-speech interval) is outputted. A decoding circuit 110 which is supplied with the input signal from the input terminal 100 at predetermined intervals of time (hereinafter referred to as frames each having a time duration of 2 ms). The decoding circuit 110 decodes the input signal into various data including a spectrum parameter (e.g., an LSP (Line Spectrum Pair) coefficient l(i), an average amplitude r, a pitch period T and a sound source signal c(n). A speech detecting circuit 120 determines speech and non-speech intervals in each frame, and outputs information indicative of a speech or non-speech interval. The speech and non-speech intervals may be determined according to the process described above, the literature 3, or other known processes.

An excitation signal generating circuit 140 generates an excitation signal v(n) using the sound source signal c(n), the average amplitude r, and the pitch period T from the decoding circuit 110. The excitation signal v(n) may be calculated according to the process described in the literature 2 referred to above. (In the literature, the equation (v(n)=r·c(n)+v(n−T)) should be referred.)

A first signal reproducing circuit 160 is supplied with the decoded spectrum parameter l(i) (e.g., the LSP coefficient), and converts the supplied spectrum parameter l(i) into a linear predictive coefficient α(i). The conversion from the spectrum parameter l(i) into the linear predictive coefficient α(i) may be carried out according to "QUANTIZER DESIGN IN LSP SPEECH ANALYSIS—SYNTHESIS" written by Sugamura, et al. (IEEE J. Sel. Areas Commun., pp. 423–431, 1988) (literature 4). The excitation signal is filtered to determine a reproduced signal according to the following equation:

$$s(n) = v(n) + \sum_{i=1}^{P} \alpha(i) s(n-i) \quad (4)$$

where s(n) is the reproduced signal, and P is the degree of the linear predictive coefficient.

A searching circuit 180 searches random number code vectors stored in a code book 200 in a frame in which the output signal from the speech detecting circuit 120 represents a non-speech interval, and selects a random number vector which well represents the reproduced signal s(n). The code book 200 is stored in a memory, preferably in a ROM. The searching circuit 180 searches the random number code vectors using the above-mentioned equations (1) and (2), and selects a code vector which maximizes the equation (1), i.e. the searching circuit 180 searches the random number code vectors to select a code vector which can be used to reproduce the sound signal closest to the sound signal from the first signal reproducing circuit 160. The impulse response h(n) in the equation (2) has been determined by being converted from the linear predictive coefficient. Reference may be made to the literature 2 for the conversion from the linear predictive coefficient into the impulse response. The random number code vectors stored in the code book 200 may be Gaussian random numbers, which may be generated according to the literature 1.

The searching circuit 180 further calculates a gain $g_j$ according to the following equation:

$$g_j = \left[ \sum_{n=0}^{N-1} s(n) s'(n) \right] / \left[ \sum_{n=0}^{N-1} s'(n) \right]^2 \quad (5)$$

where $$s'(n) = c_j(n) + \sum_{i=1}^{P} \alpha(i) s'(n-i) \quad (6)$$

Using the selected random number code vector and the calculated gain, the searching circuit 180 calculates an excitation signal v'(n) according to the equation (7) below, and outputs the calculated excitation signal v'(n) to a second signal reproducing circuit 210.

$$v'(n) = g_j(n) c_j(n) \quad (7)$$

When supplied with the calculated excitation signal v'(s), the signal reproducing circuit 210 reproduces a signal x(n) according to the following equation:

$$x(n) = v'(n) + \sum_{i=1}^{P} \alpha(i) x(n-i) \quad (8)$$

A switch 220 outputs the signal s(n) from the signal reproducing circuit 160 through an output terminal 230 in a speech interval, and outputs the signal x(n) from the signal reproducing circuit 210 through the output terminal 230 in a non-speech interval.

The above calculation by the equations (5), (6) is made for the reason that the random number code vectors in the code book 200 are normalized. The normalization makes the gain adjustment necessary when the sound signal is reproduced from the selected random number code vector for the purpose to make the average amplitude of the reproduced sound signal of the signal reproducing circuit 210 nearly equal to that of the signal reproducing circuit 160 in the non-speech interval.

Figure 2:
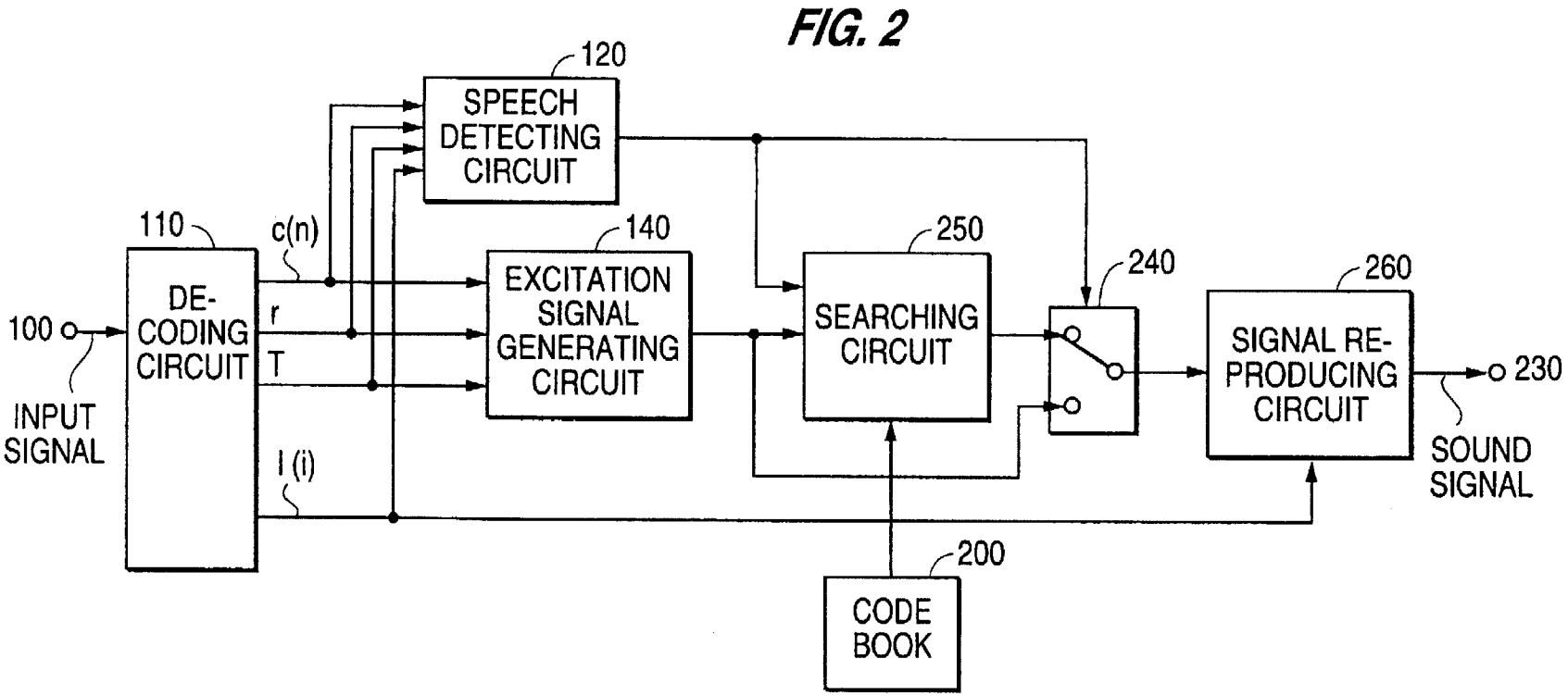
FIG. 2 is a block diagram of a speech decoder according to a second embodiment of the present invention.

FIG. 2 shows in block form a speech decoder according to a second embodiment of the present invention. Those parts shown in FIG. 2 which are identical to those shown in FIG. 1 are denoted by identical reference numerals, and will not be described in detail below.

In FIG. 2, a searching circuit 250 searches the code book 200 for a code vector $c_j(n)$ which maximizes the equation (3) referred to above, and calculates a gain $$g_j = \left[ \sum_{n=0}^{N-1} v(n)c_j(n) \right] / \left[ \sum_{n-0}^{N-1} c_j(n) \right]^2 \quad (9)$$

where v(n) is the output signal from the excitation signal generating circuit 140.

The searching circuit 250 further determines a sound source signal v'(n) according to the equation given below and outputs the determined sound source signal v'(n) to a switch 240.

$$v'(n)=g_j c_j(n) \quad (10)$$

The switch 240 outputs the signal v(n) from the excitation signal generating circuit 140 to the signal reproducing circuit 260 in a speech interval, and outputs the signal v'(n) from the searching circuit 250 to the signal reproducing circuit 260 in a non-speech interval.

In this embodiment, the configuration of the speech decoder is simplified comparing with the first embodiment, although the accuracy of selection of the random number code vector corresponding best to an original noise will be a little bit lowered.

Figure 3:
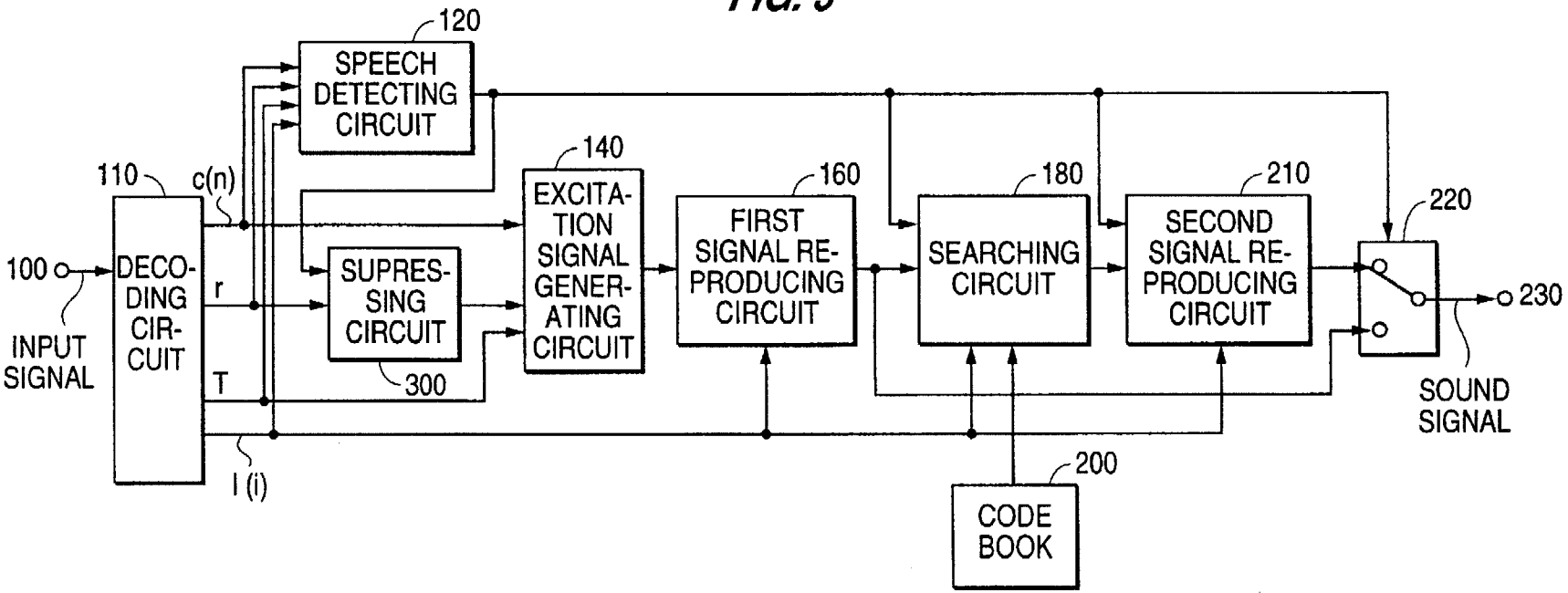
FIG. 3 is a block diagram of a speech decoder according to a third embodiment of the present invention.

FIG. 3 shows in block form a speech decoder according to a third embodiment of the present invention. Those parts shown in FIG. 3 which are identical to those shown in FIG. 1 are denoted by identical reference numerals, and will not be described in detail below.

In FIG. 3, a suppressing circuit 300 is supplied with the output signal from the speech detecting circuit 120, and suppresses an average amplitude r of the output signal from the decoding circuit 110 by a predetermined amount (e.g. 6 dB) in a non-speech interval, and thereafter outputs the signal to the excitation signal generating circuit 140. With this arrangement, a superimposed background noise signal can be suppressed in a non-speech interval.

Figure 4:
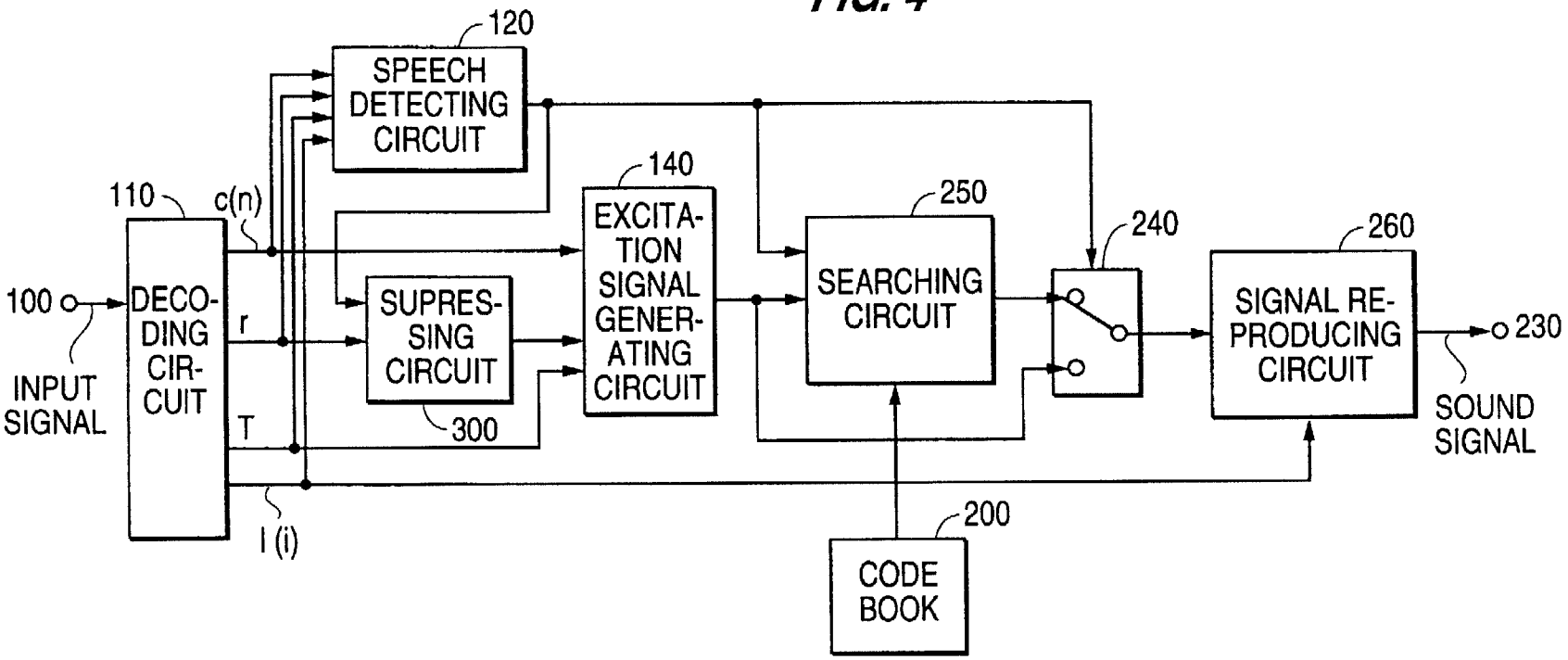
FIG. 4 is a block diagram of a speech decoder according to a fourth embodiment of the present invention.

FIG. 4 shows in block form a speech decoder according to a fourth embodiment of the present invention. Those parts shown in FIG. 4 which are identical to those shown in FIGS. 2 and 3 are denoted by identical reference numerals, and will not be described in detail below. The speech decoder shown in FIG. 4 is a combination of the speech decoders according to the second and third embodiments, and operates in the same manner as the speech decoders according to the combination of the second and third embodiments, i.e. the suppressing circuit 300 is provided on the input side of the excitation signal generating circuit 140 of the speech decoder in FIG. 2.

Figure 5:
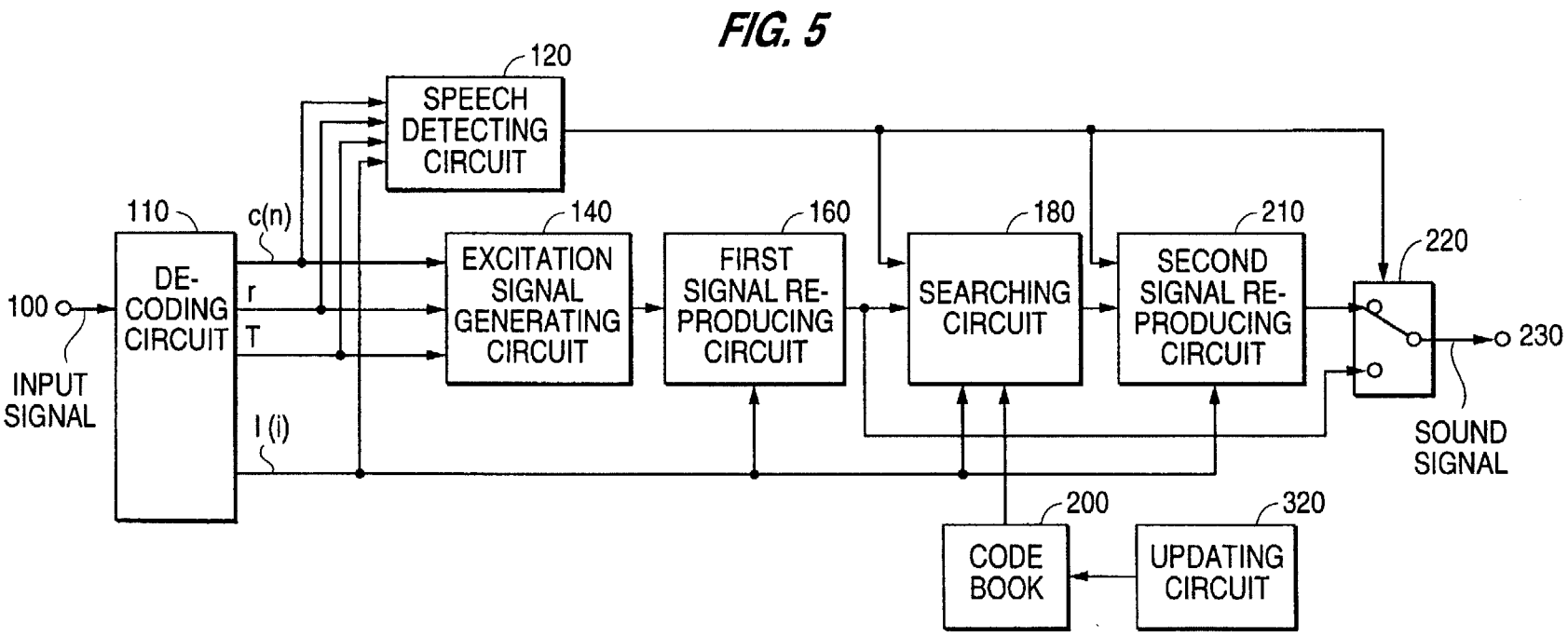
FIG. 5 is a block diagram of a speech decoder according to a fifth embodiment of the present invention.

FIG. 5 shows in block form a speech decoder according to a fifth embodiment of the present invention. Those parts shown in FIG. 5 which are identical to those shown in FIG. 1 are denoted by identical reference numerals, and will not be described in detail below.

In FIG. 5, an updating circuit 320 updates the random number code vectors stored in the code book 200 at predetermined intervals of time, e.g., frame intervals, according to predetermined rules, which may be those for changing reference values to generate random numbers. All or some of the code vectors stored in the code book 200 may be updated, and the code vectors may be updated when non-speech intervals continue or at other times.

Figure 6:
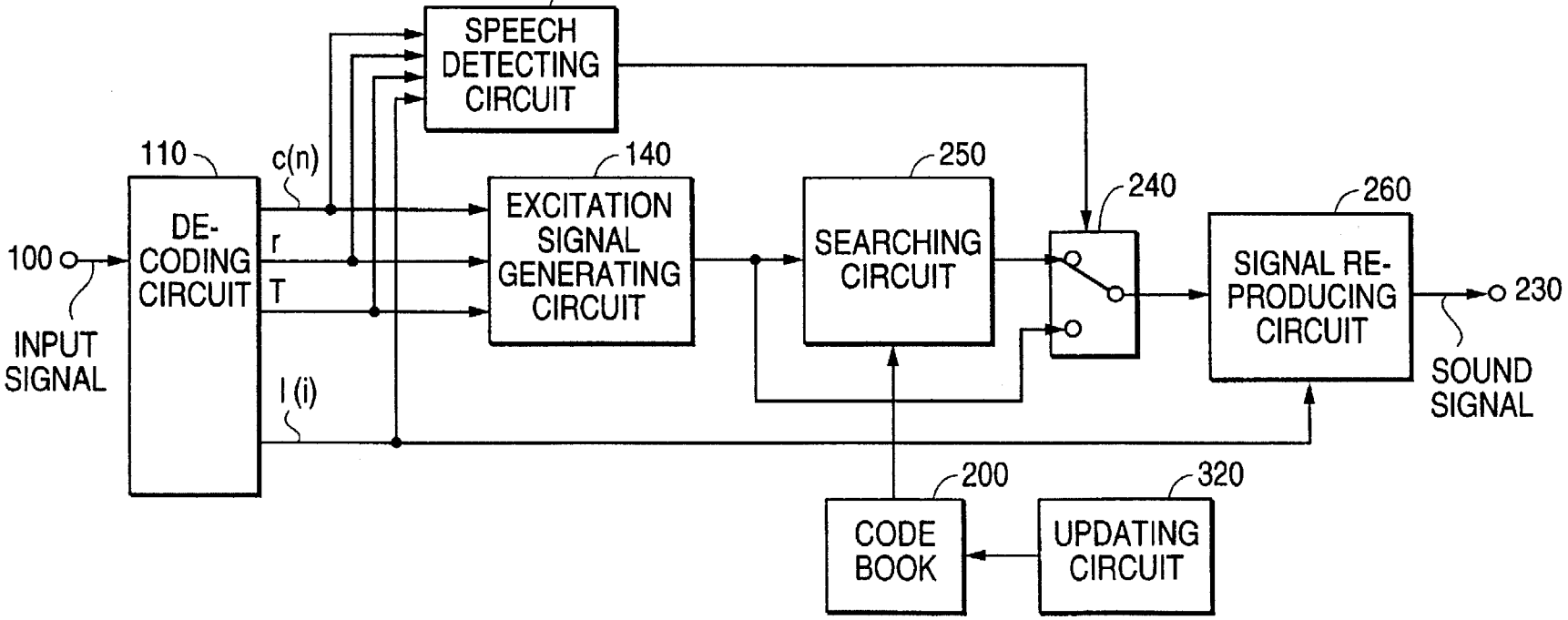
FIG. 6 is a block diagram of a speech decoder according to a sixth embodiment of the present invention.

With the arrangement shown in FIG. 6, it is possible to increase types of code vectors in the random number code book for greater randomness, so that a background noise signal can be represented better in non-speech intervals. The speech decoder shown in FIG. 6 is effective particularly when the number of bits of the random number code book is small.

FIG. 6 shows in block form a speech decoder according to a sixth embodiment of the present invention. Those parts shown in FIG. 6 which are identical to those shown in FIGS. 2 and 5 are denoted by identical reference numerals, and will not be described in detail below. The speech decoder shown in FIG. 6 is a combination of the speech decoders according to the second and fifth embodiments, and operates in the same manner as the speech decoders according to the combination of the second and fifth embodiments.

In the above embodiments, the code vectors stored in the code book 200 may be code vectors having other known statistical nature. The spectrum parameter may be another parameter than LSP.

With the present invention, as described above, when background noise is superposed on speech, the background noise can well be represented through signal processing only in the speech decoder even at low bit rates, and can be suppressed.

It is to be understood, however, that although the characteristics and advantages of the present invention have been set forth in the foregoing description, the disclosure is illustrative only, and changes may be made in the shape, size, and arrangement of the parts within the scope of the appended claims.

What is claimed is:

1. A speech decoder comprising:

decoding means for decoding a binary coded input signal into a spectral parameter, an average amplitude, a pitch period and a sound source signal;

speech detecting means for detecting a non-speech interval and a speech interval using at least one among the spectral parameter, the average amplitude and the pitch period;

excitation signal generating means for generating an excitation signal using the sound source signal, the average amplitude, and the pitch period;

first signal reproducing means for reproducing a sound signal using the excitation signal from the excitation signal generating means and the spectral parameter from said decoding means;

memorizing means for memorizing a random number code book storing random number code vectors which can be used in reproducing sound signals;

searching means for searching the random number code book and selecting a random number code vector which can be used to reproduce a sound signal that is closest to the output signal reproduced in the non-speech interval by said first signal reproducing means;

second signal reproducing means for reproducing a sound signal using the spectral parameter from said decoding means and the random number code vector which has been searched by said searching means; and switching means for outputting the sound signal from said first signal reproducing means in the speech interval and outputting the sound signal from said second signal reproducing means in the non-speech interval.

2. A speech decoder according to claim 1, wherein said searching means calculates a gain which is used by the second signal reproducing means for adjusting an average amplitude of the sound signal which is reproduced from the selected random number code vector such that the average amplitude of the sound signals of the first and second signal reproducing means becomes nearly equal in the non-speech interval.

3. A speech decoder according to claim 2, wherein said excitation signal generating means comprises suppressing means for suppressing the average amplitude in the non-speech interval.

4. A speech decoder according to claim 2, wherein said searching means comprises updating means for updating the random number code book at a predetermined interval of time.

5. A speech decoder according to claim 1, wherein said excitation signal generating means comprises suppressing means for suppressing the average amplitude in the non-speech interval.

6. A speech decoder comprising:

decoding means for decoding a binary coded input signal into a spectral parameter, an average amplitude, a pitch period and a sound source signal;

speech detecting means for detecting a non-speech interval and a speech interval using at least one among the spectral parameter, the average amplitude and the pitch period;

excitation signal generating means for generating a excitation signal using the sound source signal, the average amplitude, and the pitch period;

memorizing means for memorizing a random number code book storing random number code vectors which can be used in reproducing sound signals;

searching means for searching the random number code book for a random number code vector which can be used in reproducing a sound signal that is closest to the excitation signal in the non-speech interval;

switching means for outputting the excitation signal from said excitation signal generating means in the speech interval and outputting the random number code vector which has been searched in the non-speech interval by said searching means; and signal reproducing means for reproducing a sound signal using the spectral parameter from said decoding means and the output from the switching means.

7. A speech decoder according to claim 6, wherein said searching means calculates a gain which is used by the signal reproducing means for adjusting an average amplitude of the sound signal which is reproduced from the selected random number code vector such the excitation signal and the random number code vector selected by the searching means becomes nearly equal in the non-speech interval.

8. A speech decoder according to claim 7, wherein said excitation signal generating means comprises suppressing means for suppressing the average amplitude in the non-speech interval.

9. A speech decoder according to claim 7, wherein said searching means comprises means for updating the random number code book at a predetermined interval of time.

10. A speech decoder according to claim 6, wherein said excitation signal generating means comprises suppressing means for suppressing the average amplitude in the non-speech interval.

* * * * *